US008608582B2

(12) United States Patent
Ochi

(10) Patent No.: US 8,608,582 B2
(45) Date of Patent: Dec. 17, 2013

(54) ROCKING PLAY DEVICE

(75) Inventor: Yasushi Ochi, Kaizuka (JP)

(73) Assignee: BLD Oriental Co., Ltd. (JP)

( * ) Notice: Subject to any disclaimer, the term of this patent is extended or adjusted under 35 U.S.C. 154(b) by 0 days.

(21) Appl. No.: 13/497,116

(22) PCT Filed: Apr. 21, 2010

(86) PCT No.: PCT/JP2010/002878
§ 371 (c)(1),
(2), (4) Date: Mar. 20, 2012

(87) PCT Pub. No.: WO2011/058673
PCT Pub. Date: May 19, 2011

(65) Prior Publication Data

US 2012/0184386 A1 Jul. 19, 2012

(30) Foreign Application Priority Data

Nov. 13, 2009 (JP) ..... 2009-259836

(51) Int. Cl.
*A63G 9/16* (2006.01)
*A63G 9/00* (2006.01)

(52) U.S. Cl.
USPC ..... 472/119; 472/125

(58) Field of Classification Search
USPC ..... 472/118–125, 97, 107, 135; 297/273, 297/274, 284
See application file for complete search history.

(56) References Cited

U.S. PATENT DOCUMENTS

| | | | | |
|---|---|---|---|---|
| 4,805,898 | A | 2/1989 | Jacober | |
| 5,407,393 | A | 4/1995 | Schmidt | |
| 5,709,606 | A * | 1/1998 | Ehrman | 472/29 |
| 6,254,490 | B1 * | 7/2001 | Lawson et al. | 472/119 |
| 6,361,446 | B2 * | 3/2002 | Lawson et al. | 472/119 |
| 6,582,315 | B1 | 6/2003 | Formanski | |
| 6,875,118 | B1 * | 4/2005 | Checketts | 472/119 |
| 2009/0012122 | A1 | 1/2009 | Branch et al. | |
| 2010/0048310 | A1 | 2/2010 | Ochi | |

FOREIGN PATENT DOCUMENTS

| | | | |
|---|---|---|---|
| EP | 2058030 | A1 | 5/2009 |
| JP | 111677/1977 | U | 3/1979 |
| JP | 139254/1978 | U | 4/1980 |
| JP | 125903/1982 | U | 4/1984 |

(Continued)

OTHER PUBLICATIONS

International Search Report; Application No. PCT/JP2010/002877; Jun. 22, 2010; Japanese Patent Office.

(Continued)

*Primary Examiner* — Kien Nguyen
(74) *Attorney, Agent, or Firm* — Stevens & Showalter LLP

(57) ABSTRACT

This Invention is provided with a pair of strut 120 vertically arranged by the base substrate, a pair of swing member 131, a motor 133, and an arm provided to a rotating shaft of the motor. A pair of swing member 131 is swingably connected to an upper part of the strut 120, a guidance shaft couples each one end neighborhood of the pair of struts. Also a motor 133 is attached to the upper part of the struts 120 similarly, the arm 134 provided to the motor 133 is connected to other end neighborhood of one of swing member 131 among the pair of swing members 131, And, if the rotating shaft of the motor rotates, the other end neighborhood connected with the arm 134 is eccentric rotated, causing swing of the pair of swing member 131.

6 Claims, 4 Drawing Sheets

(56) References Cited

FOREIGN PATENT DOCUMENTS

| | | | |
|---|---|---|---|
| JP | 62-129072 | A | 6/1987 |
| JP | 73404/1989 | U | 2/1991 |
| JP | 4-15989 | U | 2/1992 |
| JP | H07-098782 | A | 4/1995 |
| JP | 7-265548 | A | 10/1995 |
| JP | 8-38649 | A | 2/1996 |
| JP | 8-211330 | A | 8/1996 |
| JP | H08-196747 | | 8/1996 |
| JP | 8-229244 | A | 9/1996 |
| JP | 9-108449 | A | 4/1997 |
| JP | H11-299635 | A | 11/1999 |
| JP | 2000-116959 | A | 4/2000 |
| JP | 2000-167254 | | 6/2000 |
| JP | 2000-197715 | | 7/2000 |
| JP | 2001-169864 | A | 6/2001 |
| JP | 2004-208844 | A | 7/2004 |
| JP | 2005-52305 | A | 3/2005 |
| JP | 2005-131215 | A | 5/2005 |
| JP | 2008-067741 | A | 3/2008 |
| JP | 2008-073497 | A | 4/2008 |
| JP | 2008-536082 | A | 9/2008 |
| JP | 2008-231904 | A | 10/2008 |
| JP | 200911421 | A | 1/2009 |
| WO | 2006025108 | A1 | 3/2006 |

OTHER PUBLICATIONS

Naoki Turuoka; Written Opinion of the International Searching Authority; Application No. PCT/JP2010/002877; Jun. 22, 2010; Japanese Patent Office.

Ochi, Yasushi; U.S. Appl. No. 13/497,070; Apr. 21, 2010 I.A. Date; entitled Tree-Shaped Decoration Apparatus.

Ochi, Yasushi; U.S. Appl. No. 13/497,081; Apr. 21, 2010 I.A. Date; entitled Rotating Amusement Apparatus.

Ochi, Yasushi; U.S. Appl. No. 13/497,085; Apr. 21, 2010 I.A. Date; entitled Slide Device.

Ochi, Yasushi; U.S. Appl. No. 13/497,095; Apr. 21, 2010 I.A. Date; entitled Amusement Apparatus.

Ochi, Yasushi; U.S. Appl. No. 13/497,102; Apr. 21, 2010 I.A. Date; entitled Amusement Apparatus.

International Search Report; Application No. PCT/JP2010/002878; May 25, 2010; Japanese Patent Office.

Yosiaki Usui; Written Opinion of the International Searching Authority; Application No. PCT/JP2010/002878; May 25, 2010; Japanese Patent Office.

International Search Report; Application No. PCT/JP2010/002872; Jun. 1, 2010; Japanese Patent Office.

Makoto Suzuki; Written Opinion of the International Searching Authority; Application No. PCT/JP2010/002872; Jun. 1, 2010; Japanese Patent Office.

International Search Report; Application No. PCT/JP2010/002873; Jun. 8, 2010; Japanese Patent Office.

Tamotu Sakai; Written Opinion of the International Searching Authority; Application No. PCT/JP2010/002873; Jun. 8, 2010; Japanese Patent Office.

International Search Report; Application No. PCT/JP2010/002875; Jun. 1, 2010; Japanese Patent Office.

International Search Report; Application No. PCT/JP2010/002876; Jul. 6, 2010; Japanese Patent Office.

Tuneaki Oota; Written Opinion of the International Searching Authority; Application No. PCT/JP2010/002876; Jul. 6, 2010; Japanese Patent Office.

* cited by examiner (A)

(B)

ROCKING PLAY DEVICE

TECHNICAL FIELD

This invention relates to a amusement apparatus, particularly, relates to a swing amusement apparatus enabling complicated swing movement.

BACKGROUND ART

Currently, a playground equipment provided with a function with various movement is developed. For example, such a vehicle amusement device (hereinafter called the playground equipment) is installed in a supermarket or department store. And the playground equipment swings by feeding a coin into the slot, and is known to date to include the example disclosed in Japanese Unexamined Pat. App. Pub. No. H08-196747.

SUMMARY OF THE INVENTION

Problem Invention is to Solve

The swing movement of the playground equipment described in the conventional art is limited as a result of swinging of only a single game member. For example, in order to swing a plurality of game members so that a playground equipment works complicatedly, it usually requires a complicated control, and it needs a specialized knowledge and a craftsman-like sense to construct control panels. Therefore, the handling to change connection of the control line is necessary for maintenance such as repair and change, and thus it takes a lot of work. In addition, it is necessary to maintain the playground equipment frequently to secure safety, and thus the playground equipment cannot be provided with a mechanism required by the complicated control.

On the other hand, there is a lot of demand for playground equipment swinging complicatedly. Therefore a playground equipment enabling such a movement by simple configuration, comprising the mechanism with excellent ability of maintenance such as repair and change, is being required.

Means for Resolving the Problem

This Invention comprises a swing amusement apparatus which is provided with a pair of struts vertically arranged by the base substrate, a pair of swing members, a motor, and with an arm provided to a rotating shaft of the motor. A pair of swing members are swingably connected to an upper part of the strut, and a guidance shaft couples each one end neighborhood of the pair of struts. Also a motor is attached to the upper part of the struts similarly, and the arm provided to the motor is connected to other end neighborhood of one of swing member among the pair of swing members. And, if the rotating shaft of the motor rotates, the other end neighborhood connected with the arm is eccentric rotated, causing swing of the pair of swing members.

By the above configuration, while the rotation of the motor, the arm provided to the motor makes eccentric rotation around the rotating shaft of the motor. One of the swing members is connected to the arm, and thus the other end neighborhood connected to the arm makes a eccentric rotation, as a result of that, the swing member starts to swing. Also a pair of swing member is connected in guidance shaft, and thus when one swing member starts to swing, other swing member swings.

In accordance with an aspect of the present invention, play device support for supporting a playground equipment is provided to the swing member, and it is desirable that the playground equipment supported by the play device support is swung. Because playground equipment is attached to the swing amusement apparatus via play device support, the playground equipment swings. In accordance with an aspect of the present invention, a shock absorber is coated in a part of the swing amusement apparatus, and a gum resin can be applied to a surface of the shock absorber. A playground equipment can be formed with the member applied the gum resin to shock absorber. And urethane can be used as the shock absorber.

Thus, when a user hits the apparatus by mistake, it reduces the user's impact, and the waterproof effect works, too, because a shock absorber is coated in the swing amusement apparatus and applies gum resin to the surface. In accordance with an aspect of the present invention, when the swing amusement apparatus is seen from top, the guidance shaft can be diagonally connected to a left and right direction. For example, a front end neighborhood of one swing member is connected to a rear end neighborhood of other swing member by the guidance shaft, and thus the swing members are connected each other so that the guidance shaft of the apparatus is diagonal to a left and right direction. At this time, when one swing member rotates by the operation of the motor, other swing member rotates in the reverse direction. That is to say, once one swing member swings to the right the other swing member swings to the left. Therefore, it can make complicated swing operation by simple configuration.

Effects of the Invention

One swing member is coupled with the arm for making eccentric rotation around the motor rotating shaft. And thus the swing member of the swing amusement apparatus of this Invention swings. Also when one swing member starts to swing, the other swing member swings, by connecting one swing member and the other swing member. It can make complicated swing operation by simple configuration. Therefore, a playground equipment which can make complicated swing operation with excellent ability of maintenance can be provided.

DESCRIPTION OF THE PREFERRED EMBODIMENT

Figure 1:
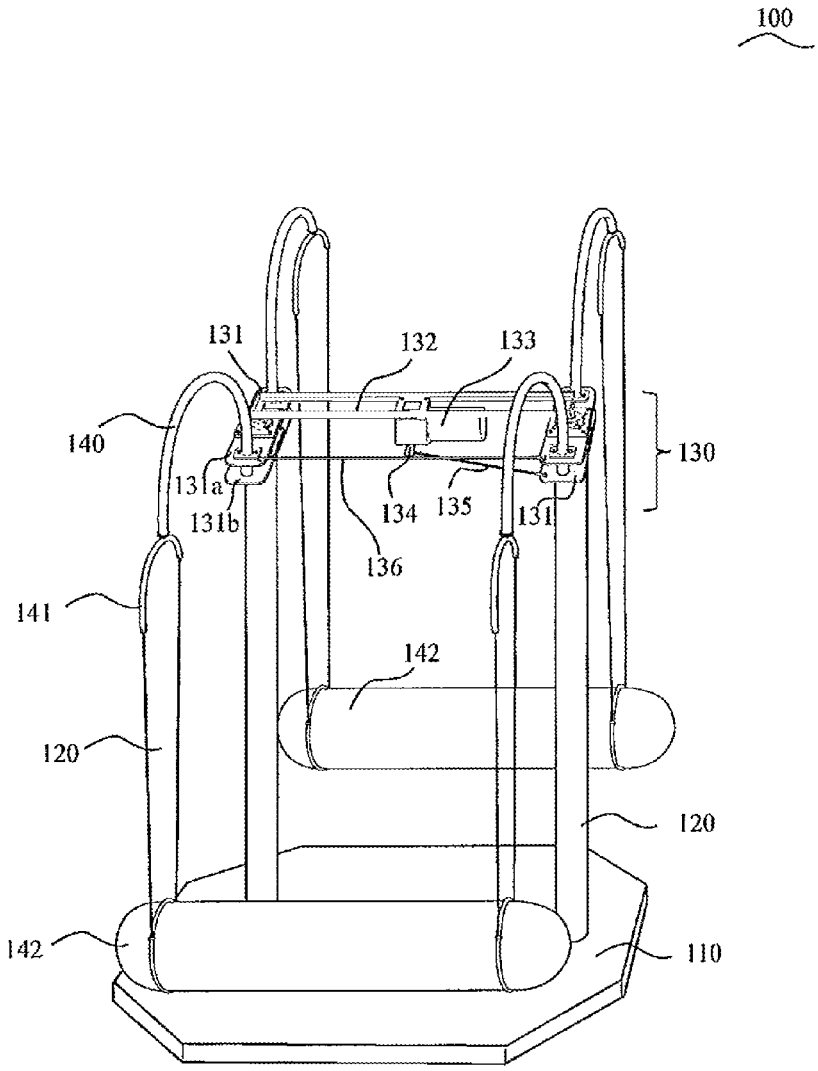
FIG. 1 is a perspective view illustrating an outlined configuration of a swing amusement apparatus in accordance with an embodiment of the present invention.
Figure 2:
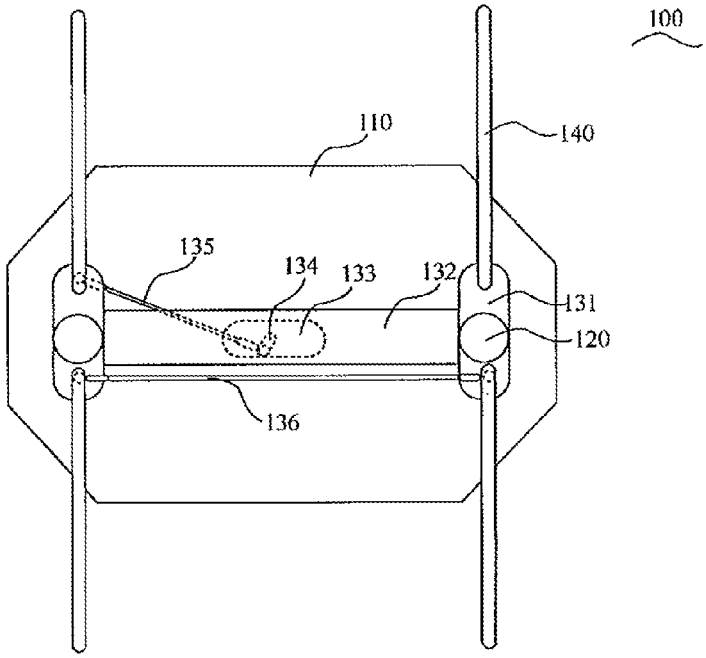
FIG. 2 is a top view illustrating a swing amusement apparatus in accordance with an embodiment of the present invention.
Figure 2:
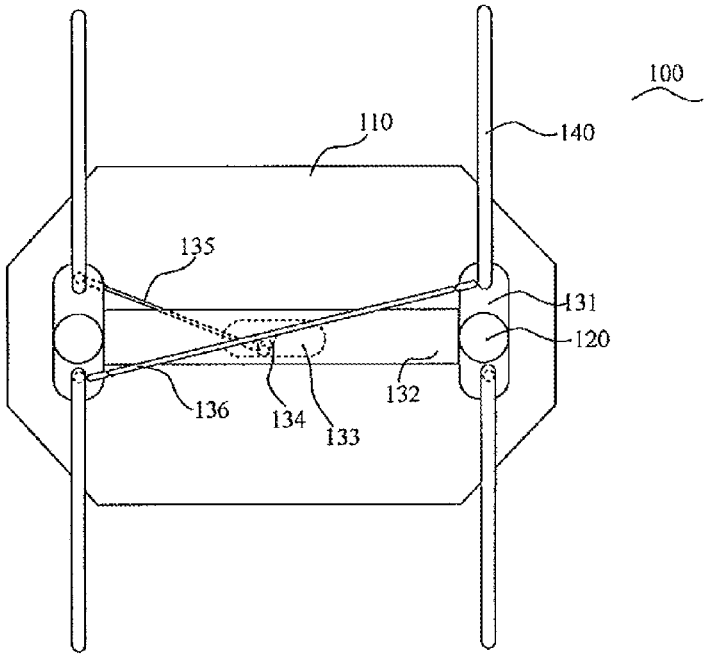
Figure 3:
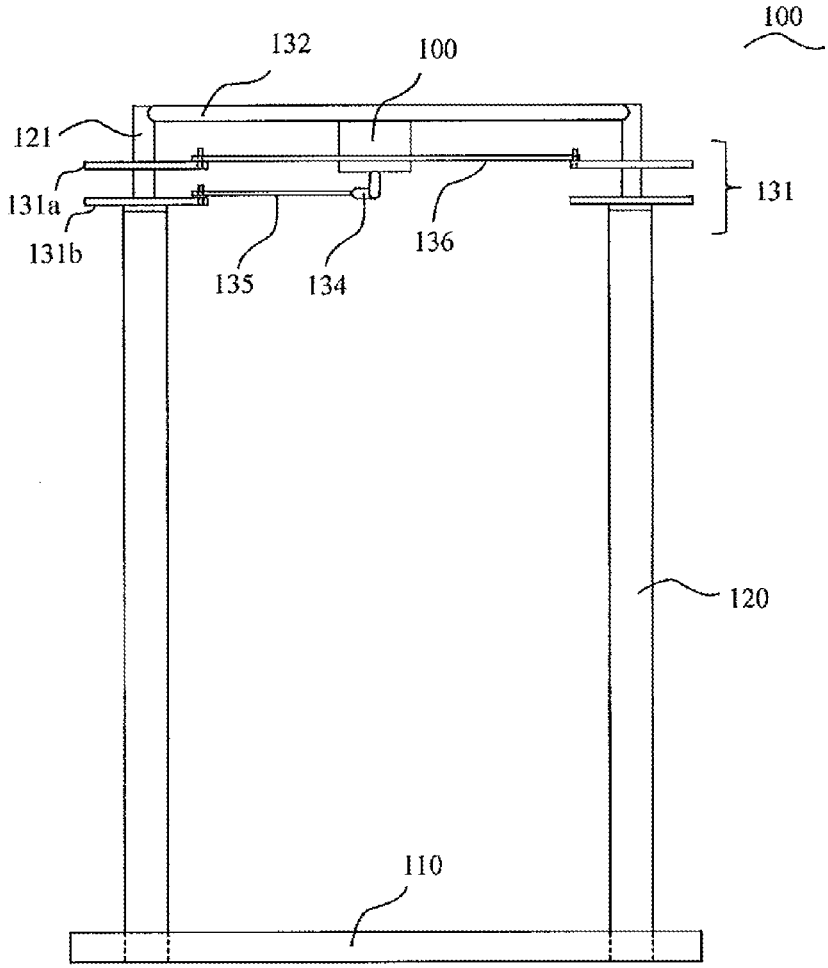
FIG. 3 is a front elevational view illustrating a swing amusement apparatus in accordance with an embodiment of the present invention.
Figure 4:
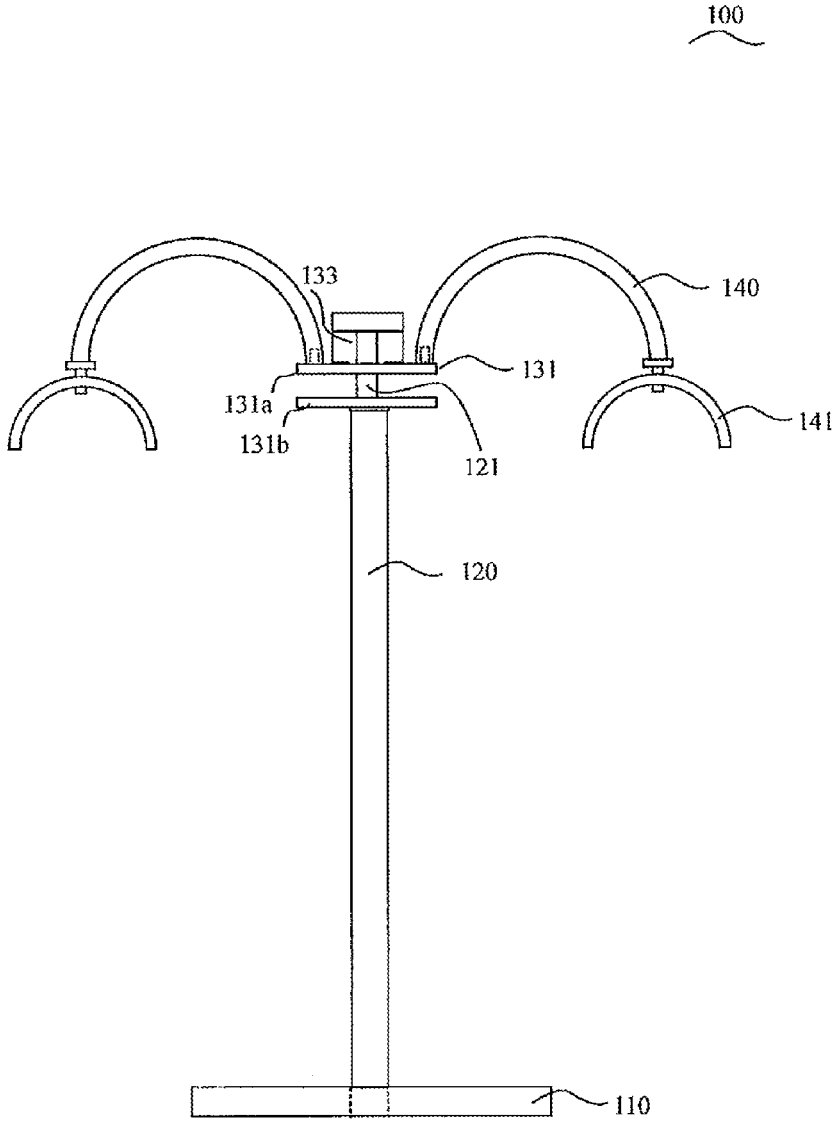
FIG. 4 is a side elevational view of a swing amusement apparatus in accordance with an embodiment of the present invention.

A specified embodiment of a swing amusement apparatus 100 is explained hereinafter with reference to the accompanying drawings. FIG. 1 is an outline schematic view of a swing amusement apparatus 100 of the present invention, FIG. 2 is a top view, FIG. 3 is a side elevational view, and FIG. 4 is a front elevational view.

However, the details of the parts which do not directly-relate to the present invention will be omitted.

Attaching a desired play device 142 (hereinafter means a structure attached to the swing amusement apparatus 100) to the swing amusement apparatus 100 of the present invention can configure a playground equipment of complicated swing movement. A playground equipment of complicated swing movement can be configured.

As illustrated in FIG. 1, a swing amusement apparatus 100 of the present invention comprises a base substrate 110 placed on an installation surface, pair of struts 120 vertically arranged by the base substrate, and a swing mechanism 130 placed on the struts 120. At first, a base substrate 110 is placed on a installation surface. For example, the base substrate 110 of a specified size can be formed by combination of a frame member of the predetermined shape. The base substrate 110 may be any shape if the struts 120 and the swing mechanism 130 placed on the struts 120 can be stably placed. For example, a octagonal base substrate 110 can be formed by combination of a plurality of prismatic columns. Octagonal base substrate 110 can be formed.

A strut 120 is stood on the base substrate 110. In the present embodiment, a hollow cylindrical strut 120 is stood on the base substrate 110. Each strut 120 is placed on the base substrate 110 within a specified distance (the distance enabling to place the motor 133) so that after-mentioned motor 133 is placed between struts 120. It is desirable the struts 20 are placed on the center of the front-rear direction (front direction shown in FIG. 3) of the base substrate 110 so that a plurality of the play devices 142 can be placed back and forth.

A plurality of supports (not shown) for standing struts 120 may be fitted in a symmetric position of the base substrate 110. A swing mechanism 130 is placed at the predetermined position of the struts 110. The swing mechanism 130 is provided with a pair of swing members 131, and a motor 133 for swinging the swing members 131. At first, a crossbar 132 for supporting a motor 133 is placed horizontally at the predetermined position (in this embodiment, near the upper end thereof) of each strut 120 vertically arranged as above. In the present embodiment, a small strut 121 is placed above each strut 120 and a crossbar 132 is placed between the small struts 121. In an embodiment of the present invention, "a strut" comprises a strut 120 and its corresponding small strut 121. The crossbar 132 may be provided with a width enabling it to support the motor 133 from the upper part or lower part. Also the motor 133 is placed under the surface of the crossbar 132, so that the crossbar 132 supports motor 133 from the upper part. And, for the swing mechanism 130, an arm 134 (any shape such as sticks or plates, is preferable) is attached to a direction perpendicular to a rotating shaft of the motor 133. The arm 134 makes eccentric rotation around a rotating shaft of the motor 133.

The motor 133 is placed in the upper part of swing amusement apparatus 100. The motor 133 is usually placed below the swing amusement apparatus 100 because the centers of gravity of the whole apparatus 100 increase for the load of the motor when the motor 133 is placed upper part of swing amusement apparatus 100.

In the present invention, the motor 133 is positioned above the swing amusement apparatus 100. The load such as users is applied to the motor 133 in the lower part, because it is assumed that a user (mean children) holds the swing amusement apparatus, in the swing amusement apparatus of the present invention. The excessive torque on the motor 133 is prevented by positioning the motor 133 above the swing amusement apparatus 100. That is to say, the motor 133 is not subject to an unnecessary torque.

A pair of swing members 131 are attached below the crossbar 132 provided to each strut 120. In the present embodiment, each swing member 131 is placed around a small strut 121 attached to the upper end of each strut 120. For example, two pieces of board paralleled up and down can be attached swingably to the small strut 121. A total of two swing members are provided.

The ends of each swing member 131 are coupled with a horizontal shaft (hereinafter called the guidance shaft 136). Thereby, once one swing member 131 swings right and left, the other swing member 131 swings in the same direction via the guidance shaft 136. As shown in FIG. 2 (A), if the front ends of each swing member 131 are coupled with the guidance shaft 136 (coupling the guidance shaft 136 as is paralleled to a straight line linking each strut 120, in a top view), two swing member 131 swings in the same direction. On the other hand, as shown in FIG. 2 (B), if front end of the one swing member is coupled with the rear end of the other swing member by the guidance shaft (coupling the guidance shaft 136 as is diagonal to a straight line linking each strut 120, in a top view), the two swing members 131 swing in the opposite direction. That is, if the front ends of the swing members 131 are coupled, once one swing member 131 swings to the right the other swing member 131 swings to the right similarly. On the other hand if the front end of the one swing member is coupled with the rear end of the other swing member, once one swing member 131 swings to the right the other swing member 131 swings to the left oppositely.

Among a pair of swing members 131, one swing member 131 is connected to the arm 134 attached to rotating shaft of the motor 133. In FIG. 1, among the positions of both ends of the swing member 131, an edge of the position coupled to guidance shaft 136 is coupled to the above arm by a shaft (hereinafter called swing shaft 135). For example, among the two boards placed up and down, two upper boards 131*a* are each other coupled by the guidance shaft, and lower board 131*b* and the arm 134 is coupled by swing shaft 135. In an embodiment of the present invention, a pair of swing members comprise a first swing member 131 comprising a pair of vertically spaced apart swing member boards 131*a* and 131*b* coupled to a first common strut and a second swing member 131 comprising a pair of vertically spaced apart swing member boards 131*a* and 131*b* coupled to a second common strut.

Other than the above, among the swing member 131, the swing member 131 may couple with above arm 134 at a position (mean opposite edge) opposite to the position coupled with guidance shaft 136. A play device 142 is attached to swing mechanism 130 configured above. At first, the hollow pipes are bent to form the play device support 140,141 of small and great size. And, one end of great size play device support 140 is attached to the upper end of swing member 131, and the neighborhood of the center of small play device support 141 is connected to the other end of play device support 140. In one embodiment of the present invention, a pair of these two play device supports 140,141 of small and great size comprises a "play device support." In another embodiment, the "play device support" may comprise four pairs of the play device supports 140,141 attached to the swing members 131. The play device 142 is attached to the small size play device support 141. The play device 142 fixed to the swing amusement apparatus 100 of this invention is preferable in any shape. The columnar cushion can be preferable as shown in FIG. 1, and a spherical, loop, and pillar shape may be formed. Even play device 142 of imitation of animals such as dolphins and other animals is preferable. All shaped play device 142 can be swung with the swing amusement apparatus 100. A user holds to and hangs to the outer peripheral surface of play device 142. And if the play device 142 is annular a user holds to and hangs to the annular inner peripheral surface.

Also an air cushion may be placed in perimeter (around base substance circumferences 110) of the strut 120. Even if a user falls off the play device 142 by mistake, an air cushion reduce the user's impact when fallen off, and user injuries can be prevented effectively. The air cushion can be configured from a seat member having a flexibility. For example, when the air cushion swells as a result of charging of the air by blowers, a hemispherical portion is formed in the midship part, and three different-sized annular sections may be formed therearound.

A specified shock absorber is coated to the swing amusement apparatus 100 of the present invention. A foam such as urethane is coated to the outer frame of the swing amusement apparatus 100 as the shock absorber. For example, the one side face of the shock absorber of the hollow cylinder is cut, so as to be coatable on the stick face. The shock absorber is coated on a part of the swing amusement apparatus 100 (even all surfaces of the apparatus are preferable coated or maybe just the part that it is expected that a user comes in contact with strut). A gum resin is painted on the surface of the shock absorber, and as a result of that, a surface of the shock absorber has a water repellency. Of course the side face (cut part) of the shock absorber will be closed when gum resin is painted. The shock absorber may be a composition like foams such as polyethylene is preferably used.

Swing amusement apparatus 100 is coated in a shock absorber so that the shock absorber reduces the impact and prevents an injury effectively even if a user falls from the swing amusement apparatus 100 by mistake. The play device 142 attached to the play device support 140,141 may be formed of the shock absorber. For example, first the shape of the animal is formed with foams (corresponding to the shock absorber) such as urethane, then a gum resin is applied to the surface thereof and thus play device 142 can be formed.

The next description is a method of use of swing amusement apparatus 100 of the present invention.

First the play device 142 desired to swing is attached to the play device support 140,141 of the swing amusement apparatus 100 of this invention. Then switch (not shown) to drive a motor 133 is pushed down and the rotating shaft of the motor 133 turns. As described above, arm 134 attached to rotating shaft rotates by rotating the rotating shaft of motor 133 and thus the end of the arm 134 makes eccentric rotation around the rotating shaft.

As described above, the swing shaft 135 combined to the end of the arm 134 rotates in same direction by eccentric rotating of the arm 134 and thus the swing member 131 combined to the swing shaft 135 starts to swing. And, because the guidance shaft 136 couples two ends of swing members 131 formed on its left and right, swinging one swing member 131 as above causes the other swing member 131 to swing.

As described above, by starting to swing the swing members 131 the play device 142 attached to the swing members 131 starts to swing via the play device support. Swinging velocities of the play device 142 can be controlled by a control means (not shown) for controlling the rotational speed of the motor 133. Also a swinging angle of the play device 142 can be controlled by adjusting the length of the arm 134 attached to the rotating shaft of the motor 133. The swinging angle is widen, by lengthened the length of the arm 134. At this time, the swing shaft 135 is linked in an arm ends neighborhood.

As discussed above, the swing amusement apparatus 100 of this invention can swing complicated movement by simple configuration. Attaching a desired play device 142 to the swing amusement apparatus 100 of the present invention can configure a playground equipment of complicated swing movement. Also a playground equipment full of changes not to make a user tired can be provided by changing the play device 142 attached to the play device support 140,141 in various kinds.

Also as for the swing amusement apparatus 100 of this invention, the swing member 131 swings by connecting a first swing member 131 and the motor 133. And another swing member 131 is connected with the first swing member 131 and guidance shaft 136 and thus two swing members 131 swing at the same time, therefore a complicated control is not required as such. In addition, the excessive torque on motor 133 is prevented by positioning the motor 133 above the swing amusement apparatus 100. Therefore, playground equipment with excellent ability of maintenance such as repair and change can be provided.

INDUSTRIAL APPLICABILITY

This invention can swing in various play device by simple configuration. The excessive torque on motor is prevented by positioning the motor above the swing amusement apparatus. It can make complicated swing operation and a playground equipment with excellent ability of maintenance can be provided without the complicated mechanism such as control panels, therefore which is highly industrial applicable. The embodiments and implementations that have been disclosed here are illustrative by nature are should not be regarded as limiting. The scope of the invention is defined by its claims rather than the foregoing description, and should be understood to include the features of the claims of the invention and equivalents thereof, in addition to all changes falling within the scope of the claims.

What is claimed is:

1. A swing amusement apparatus, comprising:

a pair of struts extending generally vertically from a base substrate;

a pair of swing members swingably connected to upper parts of the struts;

a play device support provided to the swing members, for supporting a play device;

a guidance shaft for coupling together the swing members;

a motor having a rotating shaft, the motor attached to a bar coupled to the upper parts of the struts;

an arm attached to the rotating shaft of the motor;

the arm attached to the motor being connected to one of the swing members, wherein when the rotating shaft of the motor rotates, the one swing member connected with the arm is eccentrically rotated, causing the play device supported by the play device support to swing.

2. The swing amusement apparatus according to claim 1, further comprising: a shock absorber coating a part of the swing amusement apparatus; and a gum resin applied to a surface of the shock absorber.

3. The swing amusement apparatus according to claim 2, wherein the shock absorber is urethane.

4. The swing amusement apparatus according to claim 1, wherein the play device is formed by a member including a shock absorber and a gum resin applied to the shock absorber.

5. The swing amusement apparatus according to claim 1, wherein the guidance shaft is diagonally connected to the swing members.

6. The swing amusement apparatus according to claim 1, wherein the pair of swing members comprise a first swing member comprising a pair of vertically spaced apart swing member boards coupled to a first common strut and a second swing member comprising a pair of vertically spaced apart swing member boards coupled to a second common strut.

* * * * *